US010315197B2

(12) United States Patent
Weber

(10) Patent No.: US 10,315,197 B2
(45) Date of Patent: Jun. 11, 2019

(54) APPARATUS FOR TRANSPORTING A FLUID WITHIN A CHANNEL LEG OF A MICROFLUIDIC ELEMENT

(75) Inventor: Lutz Weber, Zweibrücken (DE)

(73) Assignee: THINKKX MICROTECHNOLOGY AG, Zweibrücken (DE)

( * ) Notice: Subject to any disclaimer, the term of this patent is extended or adjusted under 35 U.S.C. 154(b) by 0 days.

(21) Appl. No.: 13/375,837

(22) PCT Filed: May 14, 2010

(86) PCT No.: PCT/DE2010/000541

§ 371 (c)(1),
(2), (4) Date: Dec. 2, 2011

(87) PCT Pub. No.: WO2010/139295

PCT Pub. Date: Dec. 9, 2010

(65) Prior Publication Data

US 2012/0082599 A1 Apr. 5, 2012

(30) Foreign Application Priority Data

Jun. 5, 2009 (DE) ..... 20 2009 008 052

(51) Int. Cl.
*B01L 3/00* (2006.01)

(52) U.S. Cl.
CPC ..... *B01L 3/50273* (2013.01); *B01L 2200/10* (2013.01); *B01L 2200/16* (2013.01);
(Continued)

(58) Field of Classification Search
CPC ..... B01L 3/50273; B01L 2300/0816; B01L 2400/0481; B01L 3/502738; B01L 2300/0809; B01L 2300/0887; B01L 2300/123; B01L 2400/0638; B01L 2400/0478; B01L 3/50; B01L 3/5027; B01L 2200/0605; B01L 2200/10; B01L 2300/0867; B01L 2300/087; B01L 2300/0877; B01L 2300/14; B01L 2400/0487; F04B 43/021; F04B 43/043
(Continued)

(56) References Cited

U.S. PATENT DOCUMENTS 4,065,263 A 12/1977 Woodbridge
4,077,845 A 3/1978 Johnson
(Continued)

FOREIGN PATENT DOCUMENTS

DE 3541057 5/1987
DE 4410224 9/1995
(Continued)

*Primary Examiner* — Dean Kwak
(74) *Attorney, Agent, or Firm* — Lucas & Mercanti, LLP; Klaus P. Stoffel

(57) ABSTRACT

The invention relates to an apparatus for transporting a fluid in a channel leg of a microfluidic element, especially of a flow cell. According to the invention, a pressure source for pressurizing a front end face (42) in transport direction of the liquid which completely fills the channel leg in cross section is provided. The pressure source preferably comprises a closed space (17; 22; 34; 36, 38, 40), in which a compressed gas, for example air, is compressible by moving the front end face (42) of the fluid transported in the channel leg.

9 Claims, 5 Drawing Sheets

(52) U.S. Cl.
CPC ..... *B01L 2300/0816* (2013.01); *B01L 2300/0864* (2013.01); *B01L 2300/14* (2013.01); *B01L 2400/0487* (2013.01)

(58) Field of Classification Search
USPC ..... 422/500, 501–505; 436/180, 47–49, 52, 436/53
See application file for complete search history.

(56) References Cited

U.S. PATENT DOCUMENTS

| | | | | |
|---|---|---|---|---|
| 4,780,418 | A | 10/1988 | Kratzer | |
| 4,999,304 | A | 3/1991 | Robertson | |
| 5,154,888 | A | 10/1992 | Zander et al. | |
| 5,591,403 | A | 7/1997 | Gavin et al. | |
| 5,863,502 | A | 1/1999 | Southgate et al. | |
| 6,012,902 | A * | 1/2000 | Parce | B01L 3/50273 417/48 |
| 6,296,020 | B1 | 10/2001 | McNeely et al. | |
| 6,458,325 | B1 | 10/2002 | Roscher et al. | |
| 6,615,856 | B2 | 9/2003 | McNeely et al. | |
| 6,955,923 | B2 | 10/2005 | Hartting | |
| 7,005,109 | B2 | 2/2006 | Husar et al. | |
| 7,125,711 | B2 | 10/2006 | Pugia et al. | |
| 7,371,330 | B2 | 5/2008 | Ducree et al. | |
| 7,754,472 | B2 | 7/2010 | Schwind et al. | |
| 7,854,897 | B2 | 12/2010 | Tanaami et al. | |
| 2002/0033193 | A1 * | 3/2002 | McNeely et al. | 137/825 |
| 2002/0124879 | A1 | 9/2002 | Kaplan et al. | |
| 2004/0184964 | A1 | 9/2004 | Watanabe et al. | |
| 2005/0214947 | A1 | 9/2005 | Cox | |
| 2005/0244308 | A1 * | 11/2005 | Tanaami et al. | 422/180 |
| 2005/0255004 | A1 | 11/2005 | Yao et al. | |
| 2006/0002817 | A1 * | 1/2006 | Bohm | B01L 3/502738 422/400 |
| 2006/0013741 | A1 | 1/2006 | Nadler | |
| 2006/0090800 | A1 * | 5/2006 | Banerjee et al. | 137/827 |
| 2006/0094119 | A1 | 5/2006 | Ismagilov et al. | |
| 2009/0047191 | A1 | 2/2009 | Zainiev et al. | |
| 2011/0041922 | A1 | 2/2011 | Ussing | |

FOREIGN PATENT DOCUMENTS

| | | | |
|---|---|---|---|
| DE | 69112984 | | 2/1996 |
| DE | 69305046 | | 4/1997 |
| DE | 19648695 | | 6/1997 |
| DE | 19933458 | | 2/2001 |
| DE | 10140699 | | 3/2003 |
| DE | 10222478 | | 12/2003 |
| DE | 102004023217 | Y | 12/2004 |
| DE | 10339452 | Y | 3/2005 |
| DE | 102005019195 | | 12/2005 |
| DE | 102004046396 | | 4/2006 |
| DE | 102004051573 | | 5/2006 |
| EP | 0501796 | | 9/1992 |
| EP | 0803288 | | 10/1997 |
| WO | 9944740 | Y | 9/1999 |
| WO | 0163270 | Y | 8/2001 |
| WO | 0212734 | | 2/2002 |
| WO | 02090771 | | 11/2002 |
| WO | 2005090970 | | 9/2005 |
| WO | 2009112030 | | 9/2009 |

* cited by examiner (a)

(b)

APPARATUS FOR TRANSPORTING A FLUID WITHIN A CHANNEL LEG OF A MICROFLUIDIC ELEMENT

The present application is a 371 of International application PCT/DE2010/000541 filed May 14, 2010, which claims priority of DE 20 2009 008 052.8, filed Jun. 5, 2009, the priority of these applications is hereby claimed and these applications are incorporated herein by reference.

BACKGROUND OF THE INVENTION

The invention relates to a device for transporting a fluid in a channel section of a microfluidic element, particularly a flow cell.

In the operation of microfluidic flow cells, as they are increasingly used for analytical and diagnostic purposes, or in syntheses as disposable products, liquids, for example, blood to be tested, must be transported within the flow cell to specific locations in order to bring the liquids into contact with, for example, reagents, or/and supply the liquids to a detection area.

A frequent task resides in separating a certain liquid quantity of liquid from a larger total sample introduced into the flow cell and to further transport the separated liquid quantity. The separated liquid quantity must frequently be further divided into partial quantities of equal or different sizes, wherein the partial quantities must be further transported. Sometimes it is also the task to bring together quantities of different liquids supplied through several channels in a single channel for the purpose of further transporting a mixture or a sequence of the quantities.

For transporting liquids within flow cells, to the trailing end of a liquid quantity in the transport direction, which in the cross-section completely fills out a channel section, pressure is applied, as this is described, for example, in U.S. Pat. Nos. 7,125,711; 6,615,856 and 6,296,020. The liquid quantity which fills out the channel section like a plug is moved because of the pressure application against the flow resistance through the channel section. The area of the channel section located in the transport direction in front of the liquid is in communication with a ventilating opening.

SUMMARY OF THE INVENTION

The invention is based on the object to create a novel device of the above-mentioned type which makes it possible to control transport processes in microfluidic elements more precisely and safely than according to the prior art and simultaneously to reduce the manufacturing effort for the microfluidic elements.

The device according to the invention which meets this object is characterized by a pressure source for applying pressure to a front end surface in the transport direction of the fluid which fills out the cross-section of the channel section.

In accordance with the invention, the fluid is not only moved through the channel section of the microfluidic element by overcoming a resistance caused by friction and capillary forces, but also by overcoming a counter-force produced by the aforementioned pressure application. The pressure applied according to the invention to the front end surface of the fluid, particularly a front liquid meniscus, prevents unintentional separations of small fluid quantities from the end surface, and leading or trailing of portions of the fluid quantity near the adjacent channel walls due to wetting, and in this manner ensures an exact delimitation of the transported fluid at the front side thereof. By connecting the channel section to the pressure source according to the invention, rather than to a ventilating opening, the microfluidic element can be closed off from the outside in a fluid-tight manner, and environmental contamination due to discharged fluid is prevented. The manufacturing effort is reduced because coatings for rendering the channel section hydrophilic or hydrophobic, valves for fluid control and/or extremely high accuracy requirements of the microstructures are unnecessary.

The pressure source, which preferably is a compressed gas source, may be an integral component of the microfluidic element, or, for example, component of an operating device to which the microfluidic element can be coupled.

In a particularly preferred embodiment of the invention, the pressure source comprises a closed space in which a pressurized gas, for example, air, can be compressed by shifting the front end surface of the fluid transported in the channel section. The pressure built up in the channel section in the closed space depending on the position of the end surface in the channel section is applied to the end surface and the force generated by this pressure must be overcome during the transport of the fluid in addition to the flow resistance.

The force used for transporting the fluid within the microfluidic element may be of different types. While for displacing the fluid in the channel section, for example, an inertia force, particularly a centrifugal force, can be used, in accordance with a preferred embodiment of the invention, the channel section can be connected to a transport pressure source which acts on the fluid in the transport direction. The transport pressure source may also be an integral component of the microfluidic element.

By means of this transport pressure source, a pressurized gas, for example, air can be applied to the rear end surface in the transport direction of a fluid quantity filling out the channel in the manner of a plug. The generated pressure force must overcome the flow resistance and the pressure force applied according to the invention at the opposite end against the plug-like fluid quantity.

In accordance with a further development of the invention, the pressure generated by the pressure force at the front end surface is in a clear functional relationship with the position of the front end surface in the channel section. This condition is approximately met by the aforementioned pressure source which comprises a closed space. If necessary, a correction factor is determined which takes the ambient temperature into consideration.

When meeting the above-mentioned condition, it may be advantageous to provide a device, for example, a pressure sensor, which determines the pressure at the front end surface, wherein the pressure sensor measures on the basis of the functional relationship the front end surface in the channel section. Thus, it is also possible to determine the position of a fluid quantity which fills out the channel section in the manner of a plug within the fluid cell and to accurately control its transport. Advantageously, the transport of the fluid can be interrupted by adjusting the pressure P1 of the transport pressure source equal to the pressure P2 at the front end surface.

By adjusting the pressure P1 of the transport pressure source to be smaller than the pressure P2 at the front end surface, the transport direction can even be reversed. Accordingly, a fluid quantity filling out the channel section in the manner of a plug can be pushed back and forth as desired within a channel section and can be positioned at desired locations, for example, in reaction areas, detection areas, filters, or areas in which it comes into contact with a reagent stored in the microfluidic element, or with a test strip which is known from diagnostics.

The pressure increase characteristics of the pressurized gas source with the closed space can advantageously be influenced in the desired manner by the fact that the closed space can be expanded by the gas compressed therein. For example, the closed space may have on one side a wall which is formed by an expandable foil.

The closed space of the pressure source can be accommodated in a plate firming the microfluidic element or/and by a separate container which can be connected to the plate.

The channel section advantageously has at least one cross-sectional expansion for forming a chamber, for example, a detection chamber, a mixing chamber, a reaction chamber or the like. In particular, the chamber may contain dry reagents, for example, substances for carrying out a PCR, or for catching analytic agents of the fluid sample, filters, membranes, test strips, lamellas for mixing, detection agents, such as, optical windows, prisms, and electrical conductors, as well as other means for analysis and synthesis.

Several channel sections may come together in the transport direction in a single channel section which is connected or can be connected to a pressure source.

The several channel sections may each be connected or connectable to a transport pressure source, so that by a sequential activation of the transport pressure sources in the single channel section, a sequence or mixture of different fluids can be produced and transported.

A channel section can also be branched in the transport direction into several channel sections which are each connected or connectable to a pressure source and a fluid quantity can be divided in this manner without the use of several pressure sources or valves into partial quantities. The counter pressure acting in accordance with the invention against the front end surfaces of the partial fluid quantities not only makes possible a uniform division of the total quantity into partial quantities, but also the spatial separation of the partial quantities by the transport gas which flows into the channel sections following the partial fluid quantities. As a result, analyses or syntheses can be carried out parallel to each other without the partial fluid quantities influencing each other.

Because, in accordance with the invention, counter pressure acts on the fluid to be transported, the complete filling of channel sections with different cross-sectional dimensions is ensured. Particularly in the case of jumps and dimension changes within a channel section, zones are usually created through which the fluid does not flow over the entire cross-section or which are not completely wetted which may lead to the inclusion of air bubbles. This is prevented by the invention.

By connecting the branches to different pressure sources, a desired ratio of the partial quantities can be adjusted.

In the following, the invention will be further explained with the aid of embodiments and the enclosed drawings referring to these embodiments. In the drawing:

DETAILED DESCRIPTION OF THE INVENTION

Figure 1:
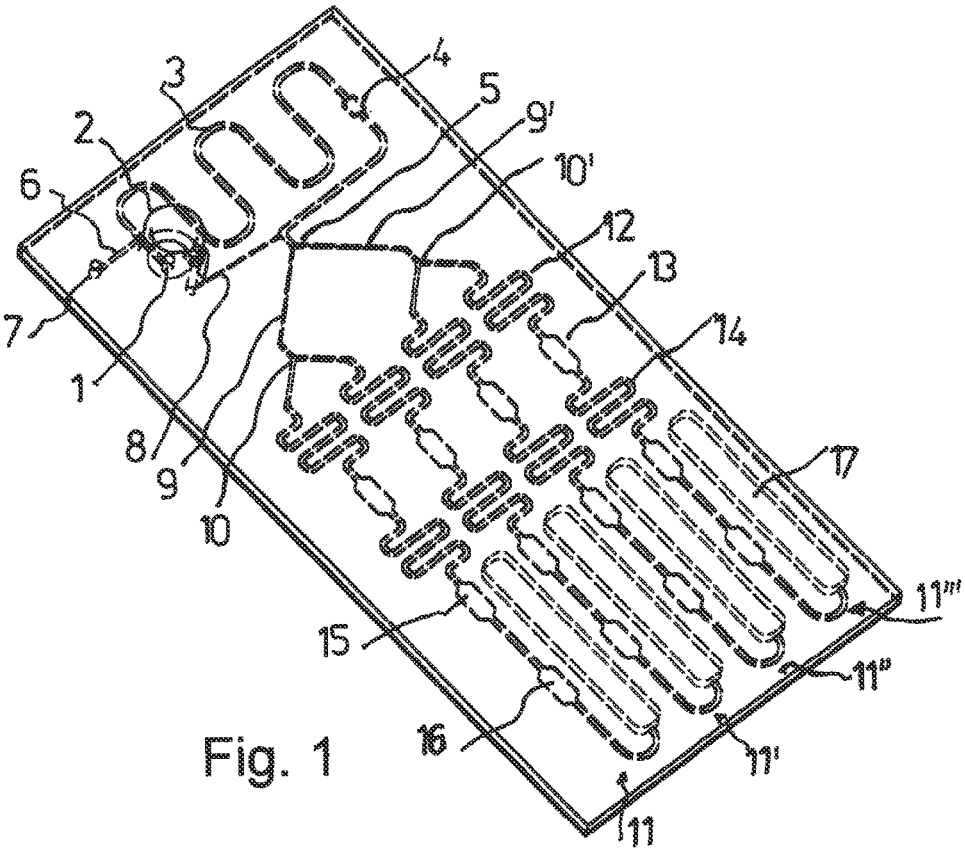
FIG. 1 shows a flow cell with a device according to the invention for transporting a fluid.
Figure 2:
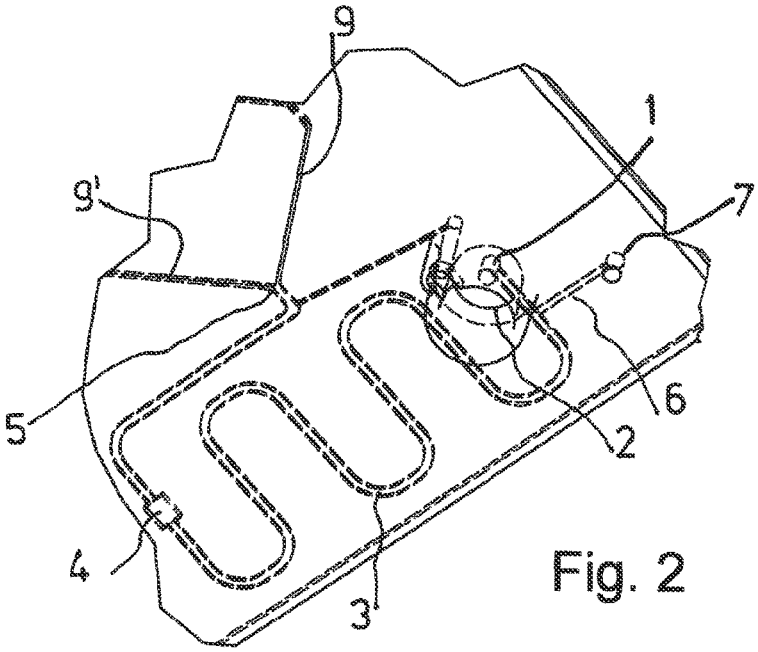
FIG. 2 shows the flow cell of FIG. 1 in a detail view.

A plate-shaped flow cell has an inlet opening 1 for a fluid, for example, a blood sample. The inlet opening 1 is located in the bottom of a cup-like supply vessel 2 integrally formed with the flow cell.

A channel 3 extends from the inlet opening, wherein the channel 3 extends in a meandering manner up to about an expanded portion 4, and from the expanded portion 4 further to a branch 5.

A channel 6 opens into the channel 9 near the inlet opening 1, wherein the channel 6 is in communication with an opening to which, as will be explained further below, a compressed air source can be connected.

A channel 8 leading to a ventilating opening branches from the channel 3 near the branch 5. The cross-section of the channel 8 is significantly smaller than the cross-section of the channel 3.

At the branch 5, the channel 3 is divided into two branch channels 9 and 9' which are symmetrical relative to the further at two additional branches 10 and 10'. Thus, the channel 3 leads into a total of four branches 11, 11', 11" and 11'".

In the illustrated embodiment the four branches are of identical construction and have identical volumes.

Each of the four branches 11, 11' 11", and 11'" includes a first meandering channel portion 12 which is followed by a channel widening 13. The channel widening 13 contains in the illustrated embodiment a dry reagent. The channel widening 13 is followed by a second meandering channel portion 14. The channel portion 14 is followed by a further channel widening 15 which, in the respective embodiment acts as a reaction chamber, and may contain an additional dry reagent, for example, reagents for carrying out a PCR.

A third widening 16 follows at a distance from the channel widening 15, wherein the widening 16 forms a detection chamber. The end of each branch 11, 11', 11", 11'" forms a chamber 17 having a volume which is significantly greater than the volume of the widenings 13, 15, and 16.

In the illustrated embodiment, the plate-shaped flow cell is composed of a plate of synthetic material which has recesses for forming the above-described channels and cavities, and a foil for closing the recesses which is welded or glued to the plastic plate in a fluid-tight manner. For manufacturing the plate, conventional plastic material processing methods, particularly injection molding, can be used. In deviating from the conscribed configuration, a substrate having several layers and laminated foils can be used. The materials to be considered are glass, silicon, metal and composite materials. To be mentioned as additional processing methods are hot embossing and laser cutting.

Various examples for the configuration of chambers or reaction and detection areas formed by channel widenings can be found in the German Patent Application 10 2009 051 395.0 of the applicant which is incorporated herein.

In the following the manner of operation of the above-described flow cell will be explained.

A fluid sample, for example, a blood sample, is introduced into the supply vessel 2 at the inlet opening 1. The channel 3 is filled up to the widening 4 as a result of capillary action. For reinforcing the capillary action, the channel 3 can be rendered hydrophilic by a plasma treatment or a wet chemical pretreatment.

As an alternative to such self-filling, the blood sample could be introduced into channel 3 by applying pressure, for example, by means of a pipette or a syringe. This task could also be taken over by an operating device provided for the flow cell. Air can escape from the channel 3 through the ventilating channel 8.

Figure 3:
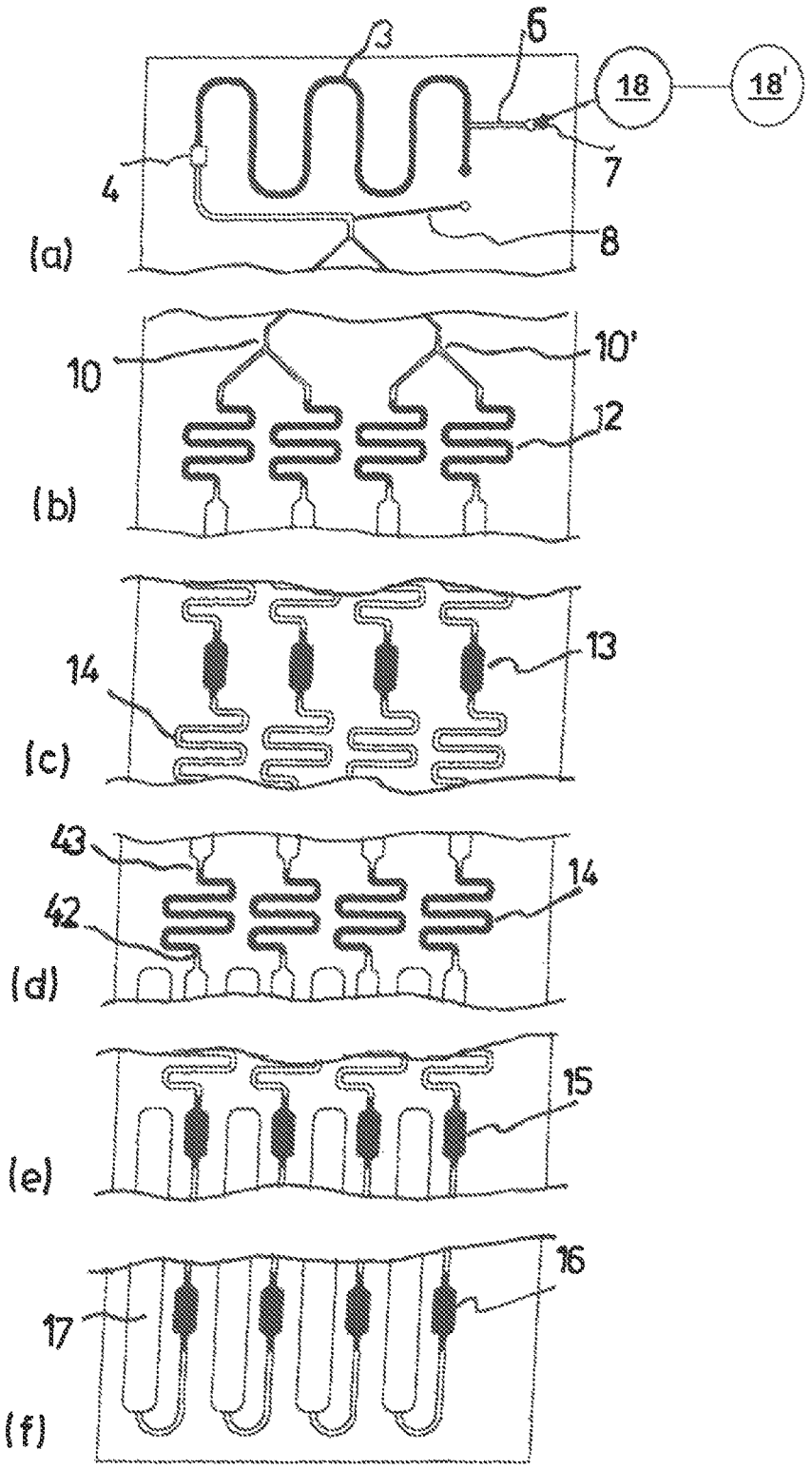
FIG. 3 is an illustration explaining the function of the flow cell of FIG. 1

The widening 4 ensures a limitation of the filling of the channel 3 and, thus, a precise dimensioning of the sample quantity, as shown in FIG. 3*a*.

For processing the sample quantity in the flow cell, the inlet opening 1 and the channel 8 are closed and the opening 7 is connected to a transport pressure/compressed air source 18 which may he a component of the operating device provided for the flow cell. 18' schematically indicates means for adjusting the transport pressure.

The measured sample quantity can be conveyed by means of the compressed air source 18 through and beyond the widening 4 in the channel 3 to the branch 5 where the sample quantity is divided into halves. Another division into halves takes placed at the branches 10 and 10', so that a quarter of the measured sample quantity reaches the branches 11, 11', 11" and 11'".

Since the branches are closed at their ends remote from the opening 7, during the transport of the fluid through the channel 3 the pressure in the chambers 17 increases due to compression. To ensure that the sample quantity and the partial sample quantities are conveyed, the air pressure P1 exerted by the compressed air source 18 must be greater than the respective air pressure P2 in the chambers 17 which acts at the front end surfaces 42 of the fluid quantities in the transport direction. The fluid quantities also each have a rear end surface 43.

Each position of the partial sample quantities filling out the channel section in a plug-like manner corresponds to a certain pressure P2 in the chambers 17. If the pressure P1 of the compressed air source 18 is equal to the pressure P2, the partial sample quantities remain in place.

In FIG. 3*b*, the partial sample quantities have just reached the channel portion 12. By increasing the pressure P1, the partial sample quantities according to FIG. 3*c* can be transferred into the widenings 13 where they each come into contact with a dry reagent. A reduction of the pressure P1 causes a return flow of the partial sample quantities into the meandering channel portions 12 where mixing takes place. A renewed increase of the pressure conveys the partial sample quantities through the channel widenings 13 into the next meandering channel portion 14. Mixing is stopped in the channel portions 14. A further increase of the pressure P1 causes a transfer into the widenings 15 where, in the illustrated embodiment, a reaction takes place, for example, PCR. The sample tests are stopped in the widening 16 wherein measurements are carried out at the samples being processed.

The compressed air source 18 may include a measuring device for determining the respective pressure P2, wherein the measuring device determines the positions of the partial quantities on the basis of a predetermined relationship between the pressure P2 and the positions of the partial quantities, and wherein the measuring device, if necessary, automatically controls the transport of the partial quantities.

Figure 4:
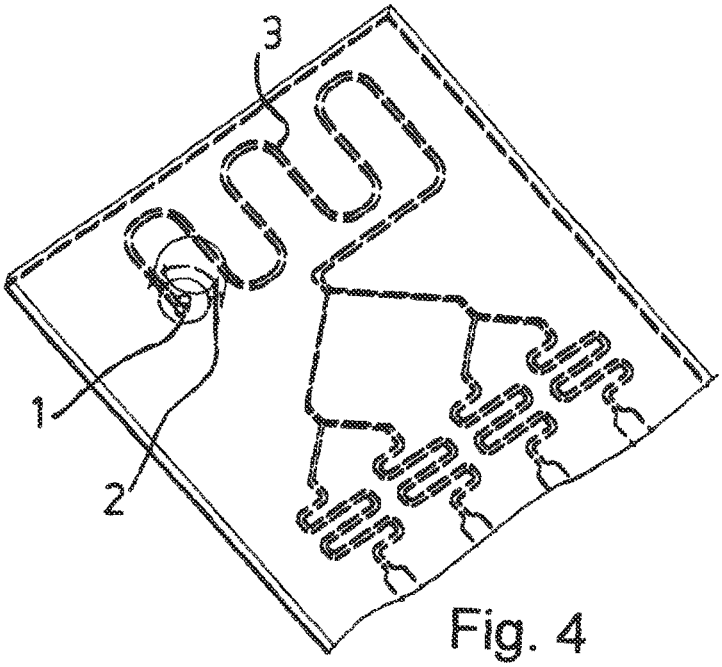
FIG. 4 shows a modification of FIG. 1.

A flow cell illustrated in FIG. 4 is essentially identical in its construction to the previously described flow cell. Only the ventilating channel 8 and the channel 6 with the opening 7 are omitted.

In this embodiment, the sample input 1 can be connected to a pressure source and a sample quantity filling out the supply vessel 2 can be pressed into the channel 3. Accordingly, the volume of the measured sample quantity is approximately equal to the volume of the supply vessel 2 or of a partial quantity predetermined by the operator. The further processing of the sample quantity measured in this manner takes place as described above.

Figure 5:
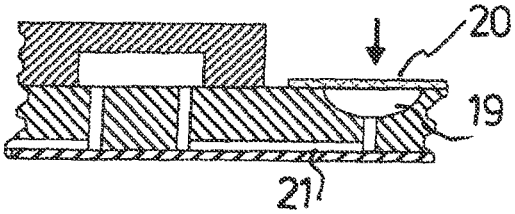
FIG. 5 shows an embodiment of a transport pressure source integrated in a microfluidic element.

Instead of a pressure source connected externally to the opening 7 or the sample input 1, 2, as shown in FIG. 5, a pressure source can also be integrated into a flow cell. In accordance with FIG. 5, such an integrated pressure source is formed by an indentation 19 which is covered by a flexible diaphragm 20.

By pressing the flexible diaphragm 20 into the indentation 19, the pressure in a pressure line 21 can be increased by a defined value.

Instead of a pressure application by means of pressurized gas, the indentation 19 could also contain a liquid. In particular, a sample liquid could flow through the space formed by the indentation 19.

Instead of the indentation and a diaphragm, it would also be possible to use a blister with a curved compressible foil hood.

In the embodiment illustrated in FIGS. 1 and 4, an "air spring" is formed by the closed chamber 17 integrated into the flow cell plate.

Figure 6:
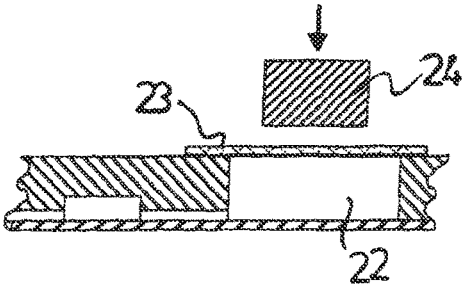

FIG. 6 shows an embodiment of an "air spring" with a chamber 22 which is covered by a flexible diaphragm 23. The diaphragm which consists, for example, of synthetic material of silicon or of TPE can expand in such a way that a desired pressure increase takes place in the chamber 22. Accordingly, the dimensions of the "air spring" in the unused state of the closed cell are advantageously smaller than in the state of operation. The curvature of the flexible diaphragm 23 delimiting the chamber 22 can be determined, for example, by means of a simple spacing sensor and can be used for the purpose of determining the pressure P2 and, thus, the position of the front fluid meniscus and for building up a control for the fluid transport in this manner.

It may be advantageous to limit the deflection of the flexible diaphragm 23 by means of an integrated or external die 24. If applicable, the volume of the chamber 22 can be adjusted in the desired manner through the position of the die. The die may be a component of an operating device.

Figure 7:
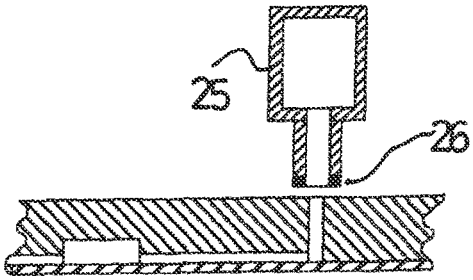
FIGS. 6 to 8 show various embodiments of a pressure source according to the invention with a closed compression space.

FIG. 7 shows a variation of an "air spring" with a separate vessel component 25 which can be attached to a flow cell, wherein a sealing ring 26 surrounds an opening formed at the flow cell plate.

Figure 8:
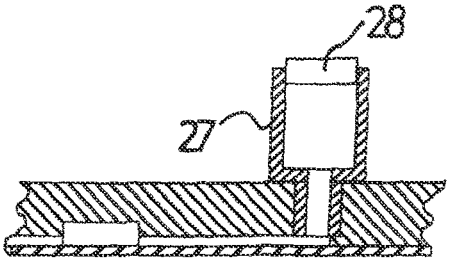

In a variation of an "air spring" illustrated in FIG. 8, a separate vessel component 27 can be placed on a flow cell, wherein, for example, a plug-like cone, a press fit or/and a LUER connection can be used.

In the embodiment according to FIG. 7 and as well as in the embodiment according to FIG. 8, the plate-shaped flow cell does not itself have to have a "spring chamber." The space required for the integrated chamber can advantageously be used for other purposes.

As illustrated in FIG. 8, the vessel component 27 has an adjustable plug 28 which makes it possible to vary the air volume of the vessel component, so that different conditions for the transport of a fluid within a flow cell can be adjusted.

It is understood that the "air spring" can be a component of an operating device and an appropriate connection to the flow cell can be effected by means of an annular seal corresponding to the connection of FIG. 7.

Figure 9:
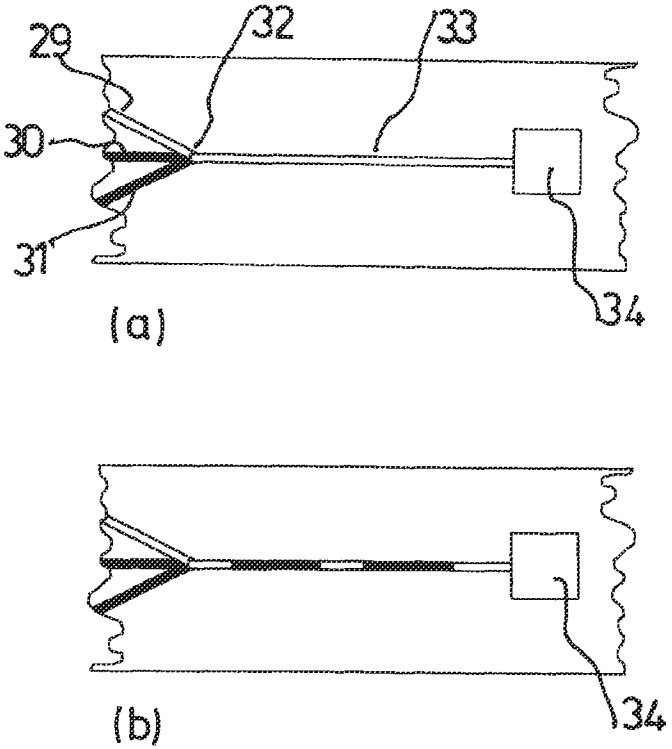
FIG. 9 shows a microelement with channel sections which come together in a single section.

While FIGS. 1 and 4 show a flow cell with only one single channel section which branches several times for the transport of a single fluid supplied through inlet opening 1, a fluid cell partially illustrated in FIG. 9 comprises three channel sections 29, 30 and 31 for the transport of different fluids. Each of the channel sections 29, 30, 31 can be connected to an inlet opening for the respective fluid and to a pressure source. Alternatively, a pressure source common to all three channel sections could be used.

The channel sections 29 through 31 come together at a mixing point 32 from which a single channel 33 extends to a closed chamber 34. By successively applying pressure to always one of the channel sections 29 through 31, sequences can be produced in the channel 33 of the different fluids contained in the channel sections 29 through 31, wherein the size of the partial quantities can be controlled through the pressure applied to the respective channel section.

Figure 10:
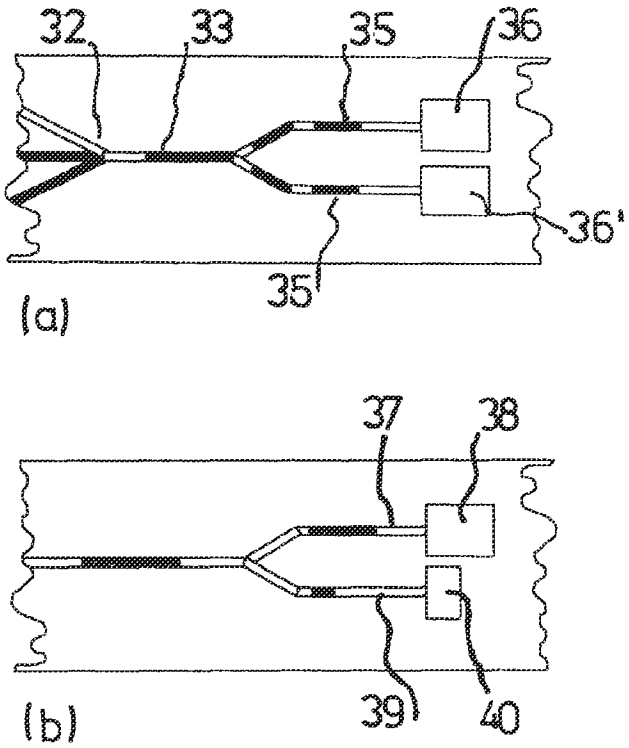
FIG. 10 shows embodiments for branching channel sections.

As seen in FIG. 10*a*, the channel 33 can once again be branched, wherein the branches 35, 35' are each in communication with an air spring chamber 36 or 36'.

A fluid sequence produced in the channel 33 at the mixing point 32 can be further divided, wherein the branches 35 and 35' each receive a sequence whose components each have half the fluid quantity of the sequence in the channel 33. This may be advantageous for simplifying the successive pressure applications to the channels 29 through 31. If fluid sequences with particularly small partial quantities are to be produced, this would require a very short and precise pressure application. When subsequently dividing an initially larger sequence into smaller sequences passively through the volumes of the partial sections, the accuracy of the volumes is determining and this accuracy can be adjusted in the manufacture of the microfluidic element very precisely by injection molding.

It is understood that because of the arrangement illustrated in FIG. 10*a* with two identical branches instead of a sequence, it is also possible to divide a single fluid package into two halves.

FIG. 10*b* shows a branched channel, wherein a branch 37 is connected to a chamber 38 and another branch 39 is connected to a chamber 40. The volume of the chamber 38 is greater than the volume of the chamber 40.

When a fluid package is transported, the pressure increases in the smaller chamber 40 faster than in the chamber 38. Correspondingly, a larger partial package is created at the branching point in the branch 37 than in the branch 39. By differently selecting the sizes of the chambers 38, 40, the ratio of the division of the fluid package at the branching point can be suitably varied.

Figure 11:
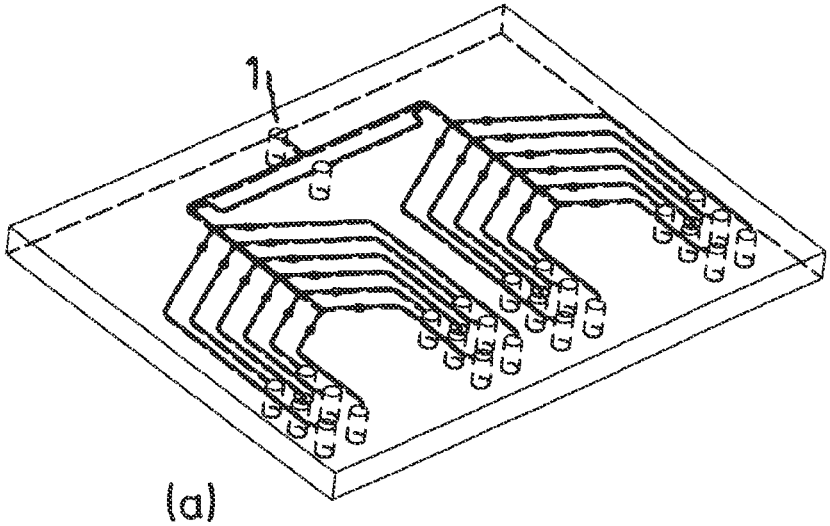
FIG. 11 shows additional embodiments for flow cells with devices according to the invention.
Figure 11:
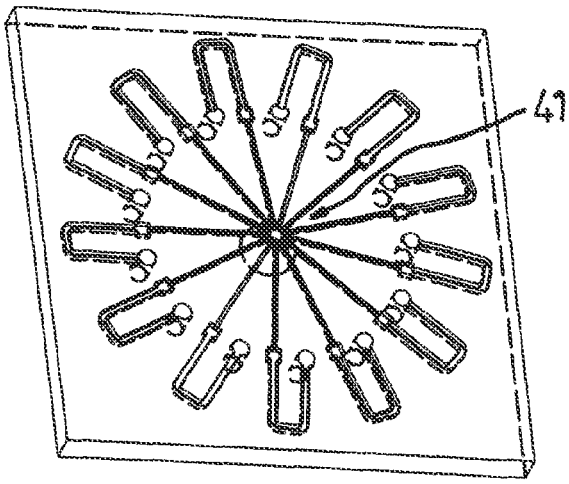

FIG. 11 shows additional embodiments of flow cells, wherein in the embodiment of FIG. 11*a* a channel section is shown with a matrix-like branching and in FIG. 11*b* an embodiment is shown with a star-shaped branching. The channel section includes a central inlet opening 41 which simultaneously forms a branching point.

It is possible to connect, for example, a pneumatic pressure source to the branching point. The embodiment of FIG. 11*b* is suitable especially for transporting fluid through centrifugal force. For this purpose, the flow cell is rotated about the inlet opening 41.

The invention claimed is:

1. A device for transporting a fluid in a channel section of a microfluidic element, comprising: a channel section configured to form a fluid quantity to be transported that fills out the channel section in a plug-like manner; a transport pressure source that provides a pressure gas for applying a transport pressure, the transport pressure source being connected or connectable to the channel section and operative to apply the transport pressure in a transport direction against a rear end surface of the fluid quantity, wherein the transport pressure is adjustable; a back pressure source comprising a closed space that is connected to the channel section opposite to the transport pressure source, and in which a second pressure gas for applying a back pressure against a front end surface of the plug-like fluid quantity is enclosed so that a pressure level of the pressure gas in the closed space is varied when the plug-like fluid quantity is displaced in the channel section; and means for adjusting a desired position of the front end surface, the adjusting means being operative to adjust the pressure level of the transport pressure source to be equal to the back pressure level that corresponds to the desired position, based on a predetermined relationship between the position of the front end surface and the back pressure, and being operative to adjust the pressure level of the transport pressure source to be above or below the pressure level of the back pressure source so that the plug-like fluid quantity is movable in both directions in the channel section, the adjusting means including a pressure sensor configured to determine the back pressure at the front end surface, the pressure sensor being connected to a measuring device configured to automatically control transport of the fluid quantity.

2. The device according to claim 1, wherein the transport pressure source is operative to adjust the pressure P1 of the transport pressure source to be smaller than the pressure P2 at the front end surface so as to reverse the transport direction.

3. The device according to claim 1, wherein the back pressure source includes an assembly that defines the closed space so that the closed space is expandable by the pressure gas compressed in the closed space.

4. The device according to claim 1, wherein the closed space is arranged within a plate forming the microfluidic element or/and by a container which is connectable to the plate.

5. The device according to claim 1, wherein the channel section has at least one section widening for forming a chamber.

6. The device according to claim 1, wherein several channel sections come together in a single channel section which is connected or is connectable to the back pressure source.

7. The device according to claim 6, wherein the several channel sections are each connected or connectable to the transport pressure source.

8. The device according to claim 1, wherein the channel section is branched in the transport direction into several channel sections which are each connected or connectable to the back pressure source.

9. The device according to claim 8, wherein the branches are connected to different back pressure sources.

* * * * *